US011044555B2

(12) United States Patent
Vilkamo et al.

(10) Patent No.: US 11,044,555 B2
(45) Date of Patent: Jun. 22, 2021

(54) APPARATUS, METHOD AND COMPUTER PROGRAM FOR OBTAINING AUDIO SIGNALS

(71) Applicant: Nokia Technologies Oy, Espoo (FI)

(72) Inventors: Juha Vilkamo, Helsinki (FI); Jussi Virolainen, Espoo (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/310,010

(22) PCT Filed: Jun. 20, 2017

(86) PCT No.: PCT/FI2017/050459

§ 371 (c)(1),
(2) Date: Dec. 14, 2018

(87) PCT Pub. No.: WO2018/002428

PCT Pub. Date: Jan. 4, 2018

(65) Prior Publication Data

US 2019/0182587 A1 Jun. 13, 2019

(30) Foreign Application Priority Data

Jun. 30, 2016 (GB) ..... 1611377.1

(51) Int. Cl.
*H04R 3/00* (2006.01)
*G10L 25/18* (2013.01)
(Continued)

(52) U.S. Cl.
CPC ..... *H04R 3/005* (2013.01); *G10L 25/18* (2013.01); *G10L 25/21* (2013.01); *H04R 1/406* (2013.01);
(Continued)

(58) Field of Classification Search
CPC .. H04R 3/005; H04R 1/406; H04R 2201/401; H04R 2430/03; H04R 2430/20;
(Continued)

(56) References Cited

U.S. PATENT DOCUMENTS 8,208,664 B2 * 6/2012 Iwasaki ..... H04M 3/568 381/310
2006/0104458 A1 * 5/2006 Kenoyer ..... H04R 3/005 381/92
(Continued)

FOREIGN PATENT DOCUMENTS

CN 101218853 A 7/2008

OTHER PUBLICATIONS

Kowalczyk, Konrad, et al., "Parametric Spatial Sound Processing [A flexible and efficient solution to sound scene acquisition, modification, and reproductions]", IEEE Signal Processing Magazine, Mar. 2015, 12 pgs.

*Primary Examiner* — William A Jerez Lora
(74) *Attorney, Agent, or Firm* — Harrington & Smith

(57) ABSTRACT

An apparatus, electronic device, method and computer program wherein the apparatus includes: processing circuitry; and memory circuitry including computer program code, the memory circuitry and the computer program code configured to, with the processing circuitry, enable the apparatus to perform: obtaining spatial information relating to a captured sound field from a first set of microphones; obtaining one or more signals from a second set of microphones where the one or more signals relate to the captured sound field; and using the obtained spatial information from the first set of microphones to process the one or more signals obtained from the second set of microphones; wherein the first set of
(Continued)

microphones is provided within an electronic device and the second set of microphones is provided external to the electronic device.

20 Claims, 5 Drawing Sheets

(51) Int. Cl.
*G10L 25/21* (2013.01)
*H04R 1/40* (2006.01)
*H04S 7/00* (2006.01)

(52) U.S. Cl.
CPC .... *H04R 2201/401* (2013.01); *H04R 2430/03* (2013.01); *H04R 2430/20* (2013.01); *H04S 7/30* (2013.01); *H04S 2400/11* (2013.01)

(58) Field of Classification Search
CPC . G10L 25/18; G10L 25/21; H04S 7/30; H04S 2400/11
USPC ..... 381/1, 2, 17–23, 26, 58, 92, 306, 309, 381/310, 313; 382/103, 106
See application file for complete search history.

(56) References Cited

U.S. PATENT DOCUMENTS

2008/0004729 A1 1/2008 Hiipakka ..... 700/94
2008/0170717 A1* 7/2008 Liu ..... G01S 5/30 381/92
2009/0110212 A1* 4/2009 Iwasaki ..... H04M 3/56 381/92
2010/0061558 A1 3/2010 Faller ..... 381/23
2013/0010980 A1* 1/2013 Yoshioka ..... G01S 3/808 381/92
2013/0093831 A1* 4/2013 Cutler ..... H04N 7/142 348/14.01
2013/0142341 A1 6/2013 Del Galdo et al. ..... 381/23
2014/0213329 A1 7/2014 Wu et al.
2014/0376740 A1* 12/2014 Shigenaga ..... G08B 13/19652 381/92
2015/0156578 A1 6/2015 Alexandridis et al. ..... 201/1
2015/0371104 A1* 12/2015 Fung ..... G06T 7/75 348/50
2016/0005407 A1* 1/2016 Friedrich ..... G10L 19/167 381/22
2017/0200444 A1* 7/2017 O'Connell ..... G10K 11/17885

* cited by examiner

APPARATUS, METHOD AND COMPUTER PROGRAM FOR OBTAINING AUDIO SIGNALS

CROSS REFERENCE TO RELATED APPLICATION(S)

This patent application is a U.S. National Stage application of International Patent Application Number PCT/FI2017/050459 filed Jun. 20, 2017, which is hereby incorporated by reference in its entirety, and claims priority to GB 1611377.1 filed Jun. 30, 2016.

TECHNOLOGICAL FIELD

Examples of the disclosure relate to an apparatus, method and computer program for obtaining audio signals. In particular, they relate to an apparatus, method and computer program for obtaining high quality spatial audio signals.

BACKGROUND

Electronic devices comprising microphones and other components are known. For example, image capturing devices may comprise one or more cameras and one or more microphones. Having the microphones integrated into the same electronic device as the other components may reduce the quality of the audio signals that can be captured by the microphones.

BRIEF SUMMARY

According to some, but not necessarily all, examples of the disclosure there may be provided an apparatus comprising: processing circuitry; and memory circuitry including computer program code, the memory circuitry and the computer program code configured to, with the processing circuitry, enable the apparatus to perform: obtaining spatial information relating to a captured sound field from a first set of microphones; obtaining one or more signals from a second set of microphones where the one or more signals relate to the captured sound field; and using the obtained spatial information from the first set of microphones to process the one or more signals obtained from the second set of microphones; wherein the first set of microphones is provided within an electronic device and the second set of microphones is provided external to the electronic device.

The spatial information from the first set of microphones may be used to spatially process the one or more signals obtained from the second set of microphones.

The second set of microphones may be arranged to obtain a higher quality audio signal than the first set of microphones.

The second set of microphones may comprise one or more higher quality microphones than the first set of microphones.

The second set of microphones may be separated from components which reduce the quality of the audio signal.

The first set of microphones may be arranged in a predetermined geometry.

The first set of microphones may be provided within an image capturing device.

The first set of microphones may comprise more microphones than the second set of microphones.

The second set of microphones may be positioned close to the electronic device so that the first set of microphones and the second set of microphones are positioned in a similar sound field.

The spatial information may be obtained using a spatial audio capture process.

The spatial information may comprise information indicating the energy ratios for each microphone in the first set of microphones within each of a plurality of frequency bands as a function of time.

The second set of microphones may be coupled to the electronic device.

According to some, but not necessarily all, examples of the disclosure there may be provided an electronic device comprising an apparatus as claimed in any preceding claims.

According to some, but not necessarily all, examples of the disclosure there may be provided a method comprising: obtaining spatial information relating to a captured sound field from a first set of microphones; obtaining one or more signals from a second set of microphones where the one or more signals relate to the captured sound field; and using the obtained spatial information from the first set of microphones to process the one or more signals obtained from the second set of microphones; wherein the first set of microphones is provided within an electronic device and the second set of microphones is provided external to the electronic device.

The spatial information from the first set of microphones may be used to spatially process the one or more signals obtained from the second set of microphones.

The second set of microphones may be arranged to obtain a higher quality audio signal than the first set of microphones.

The second set of microphones may comprise one or more higher quality microphones than the first set of microphones.

The second set of microphones may be separated from components which reduce the quality of the audio signal.

The first set of microphones may be arranged in a predetermined geometry.

The first set of microphones may be provided within an image capturing device.

The first set of microphones may comprise more microphones than the second set of microphones.

The second set of microphones may be positioned close to the electronic device so that the first set of microphones and the second set of microphones are positioned in a similar sound field.

The spatial information relating to an audio signal may be obtained using a spatial audio capture process.

The spatial information may comprise information indicating the energy ratios for each microphone in the first set of microphones within each of a plurality of frequency bands as a function of time.

The second set of microphones may be coupled to the electronic device.

According to some, but not necessarily all, examples of the disclosure there may be provided a computer program comprising computer program instructions that, when executed by processing circuitry, enable: obtaining spatial information relating to a captured sound field from a first set of microphones; obtaining one or more signals from a second set of microphones where the one or more signals relate to the captured sound field; and using the obtained spatial information from the first set of microphones to process the one or more signals obtained from the second set of microphones; wherein the first set of microphones is provided within an electronic device and the second set of microphones is provided external to the electronic device.

According to some, but not necessarily all, examples of the disclosure there may be provided a computer program comprising program instructions for causing a computer to perform the methods described above.

According to some, but not necessarily all, examples of the disclosure there may be provided a physical entity embodying the computer program as described above.

According to some, but not necessarily all, examples of the disclosure there may be provided an electromagnetic carrier signal carrying the computer program as described above.

According to some, but not necessarily all, examples of the disclosure there may be provided an apparatus comprising: means for obtaining spatial information relating to a captured sound field from a first set of microphones; means for obtaining one or more signals from a second set of microphones where the one or more signals relate to the captured sound field; and means for using the obtained spatial information from the first set of microphones to process the one or more signals obtained from the second set of microphones; wherein the first set of microphones is provided within an electronic device and the second set of microphones is provided external to the electronic device.

According to various, but not necessarily all, examples of the disclosure there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
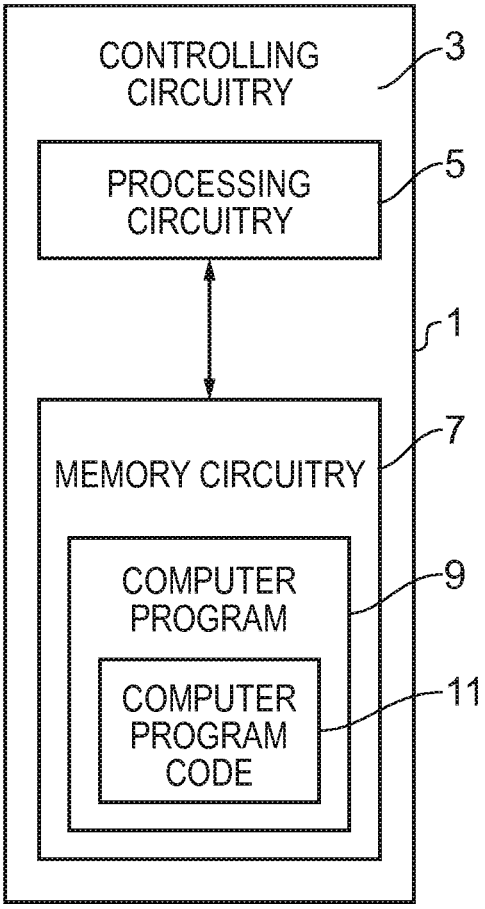
FIG. 1 illustrates an apparatus.

The Figures illustrate an apparatus 1 comprising: processing circuitry 5; and memory circuitry 7 including computer program code 11, the memory circuitry 7 and the computer program code 11 configured to, with the processing circuitry 5, enable the apparatus 1 to perform: obtaining 51 spatial information 39 relating to a captured sound field from a first set of microphones 23; obtaining 53 one or more signals from a second set of microphones 27 where the one or more signals relate to the captured sound field; and using the obtained spatial information 39 from the first set of microphones 23 to process the one or more signals obtained from the second set of microphones 27; wherein the first set of microphones 23 is provided within an electronic device 21 and the second set of microphones 27 is provided external to the electronic device 21.

The apparatus 1 may be for obtaining audio signals. The apparatus 1 may be for obtaining high quality spatial audio signals. Such apparatus 1 could be used in presence capture devices, image capturing devices, virtual reality systems or any other suitable electronic devices or systems.

FIG. 1 schematically illustrates an example apparatus 1 which may be used in examples of the disclosure. The apparatus 1 illustrated in FIG. 1 may be a chip or a chip-set. In some examples the apparatus 1 may be provided within an electronic device 21. The electronic device 21 could be a presence capture device, image capturing device, virtual reality system or any other suitable electronic device. In some examples the apparatus 1 may be provided in an electronic device such as a processing device or a playback device.

The example apparatus 1 comprises controlling circuitry 3. The controlling circuitry 3 may provide means for controlling an electronic device 21. The controlling circuitry 3 may also provide means for performing the methods or at least part of the methods of examples of the disclosure.

The processing circuitry 5 may be configured to read from and write to memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enable the apparatus 1 to perform the example methods, or at least part of the example methods illustrated in FIGS. 5 to 7. The processing circuitry 5, by reading the memory circuitry 7, is able to load and execute the computer program 9.

In some examples the computer program 9 may comprise an audio signal processing application. The audio signal processing application may be arranged to obtain spatial information 39 from a first set of microphones 23 and use this spatial information 39 to spatially process 45 one or more signals obtained from a second set of microphones 27. The first set of microphones 23 may be provided within an electronic device 21 and the second set of microphones 27 may be positioned external to, the electronic device 21 so that the second set of microphones 27 obtains a higher quality audio signal than the first set of microphones 23. The higher quality audio signal may have a higher signal to noise ratio, may be better protected from external noises such as wind or may have any other parameters which enable a better audio signal to be provided to a user.

The apparatus 1 therefore comprises: processing circuitry 5; and memory circuitry 7 including computer program code 11, the memory circuitry 7 and computer program code 11 configured to, with the processing circuitry 5, cause the apparatus 1 at least to perform: obtaining 51 spatial information 39 relating to a captured sound field from a first set of microphones 23; obtaining 53 one or more signals from a second set of microphones 27 where the one or more signals relate to the captured sound field; and using the obtained spatial information 39 from the first set of microphones 23 to process the one or more signals obtained from the second set of microphones 27; wherein the first set of microphones 23 is provided within an electronic device 21 and the second set of microphones 27 is provided external to the electronic device 21

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), or an article of manufacture that tangibly embodies the computer program. The delivery mechanism may be a signal configured to reliably transfer the computer program 9. The apparatus 1 may enable the propagation or transmission of the computer program 9 as a computer data signal. In some examples the computer program code 11 may be transmitted to the apparatus 1 using a wireless protocol such as Bluetooth, Bluetooth Low Energy, Bluetooth Smart, 6LoWPan (IP,6 over low power personal area networks) ZigBee, ANT+, near field communication (NFC), Radio frequency identification, wireless local area network (wireless LAN) or any other suitable protocol.

Although the memory circuitry 7 is illustrated as a single component in the figures it is to be appreciated that it may be implemented as one or more separate components some or all of which may be integrated/removable and/or may provide permanent/semi-permanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures, Reduced Instruction Set Computing (RISC) and sequential (Von Neumann)/parallel architectures but also specialized circuits such as field-programmable gate arrays (FPGA), application-specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Figure 2:
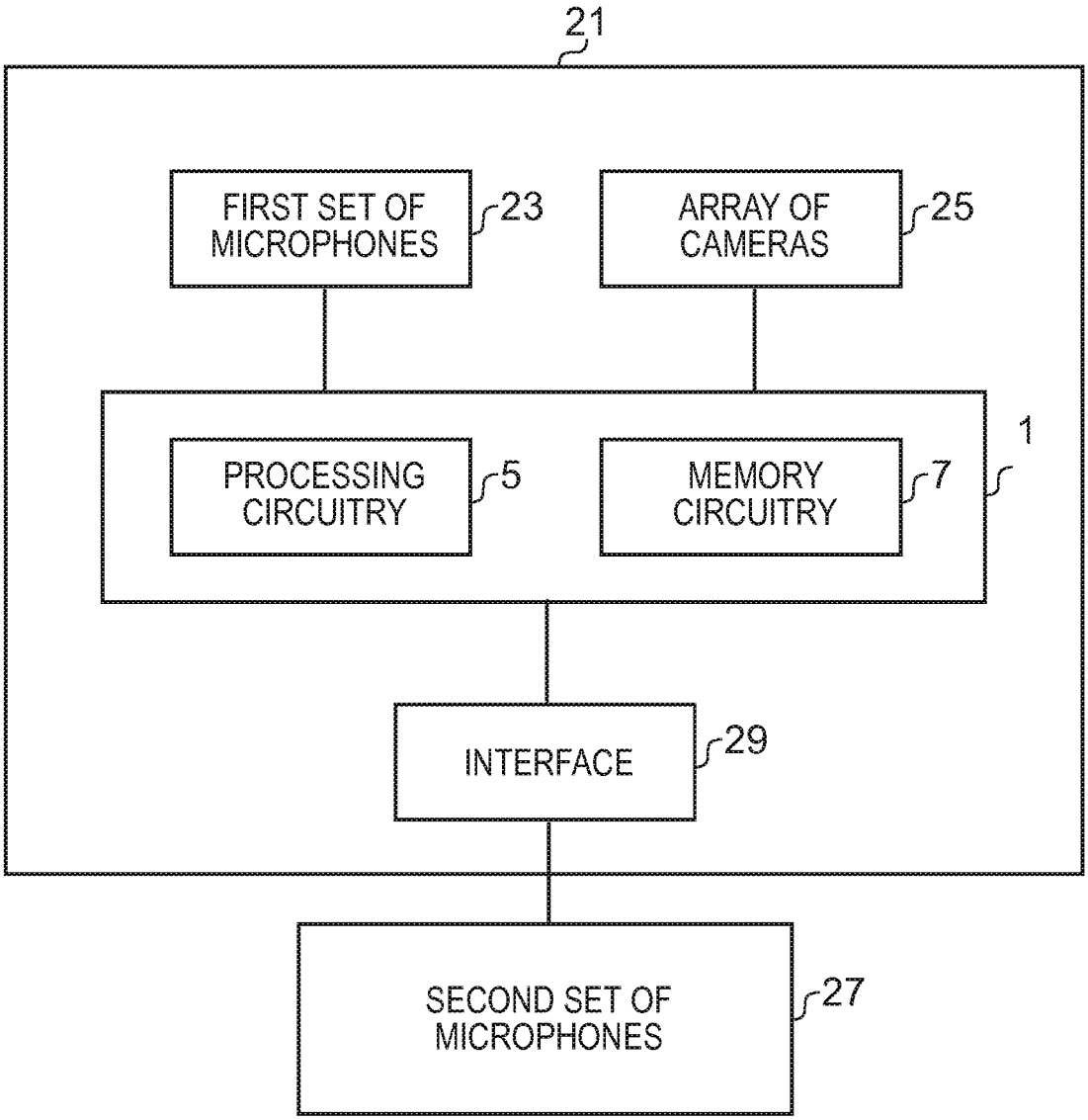
FIG. 2 illustrates an electronic device.

FIG. 2 schematically illustrates an example electronic device 21. The electronic device 21 comprises an apparatus 1 comprising processing circuitry 5 and memory circuitry 7 as described above. Corresponding reference numerals are used for corresponding features. In addition to the apparatus 1 the example electronic device 21 of FIG. 2 also comprises a first set of microphones 23, an array of cameras 25 and an interface 29. It is to be appreciated that the electronic device 21 may comprise other features which are not illustrated in FIG. 2 such as a power source, cooling components or any other suitable features.

FIG. 2 also illustrates a second set of microphones 27. The second set of microphones 27 are provided external to the electronic device 21. The example electronic device 21 of FIG. 2 may be configured to enable spatial information 39 relating to a captured sound field to be obtained. The captured sound field may comprise one or more sound sources. The spatial information 39 may be used to process the one or more signals that are obtained by the second set of microphones 27.

The first set of microphones 23 may comprise any means which enables spatial information 39 relating to an audio signal to be obtained. The microphones within the first set of microphones 23 may comprise any means which may be configured to convert an acoustic input signal to an electrical output signal. The first set of microphones 23 may be coupled to the apparatus 1 to enable the apparatus 1 to process signals 31 detected by the first set of microphones 23 and obtain the spatial information 39 relating to the signal 31. The signal 31 may relate to captured sound field. The first set of microphones 23 may enable at least part of a sound field to be captured. The first set of microphones 23 may enable signal information from spatially sampled positions in the sound field to be obtained.

The first set of microphones 23 comprises a plurality of microphones. The plurality of microphones are arranged in different positions within the electronic device 21 so as to enable spatial information 39 to be obtained by the first set of microphones 23. The spatial information 39 may comprise any information which may be used for the spatial processing 45 of the one or more signals 33 obtained by the second set of microphones 27. The spatial information 39 comprises information indicating spatial parameters such as a direction parameter. The spatial information may comprise information indicating a directional property of the captured sound field. In some examples the spatial information may comprise a ratio, or an energy parameter which indicates the directionality of captured sound field. The ratio or energy parameter may indicate how much of the captured sound energy is directional. The ratio or energy parameter may also indicate how much of the captured sound energy is non-directional. The non-directional sound energy may be diffuse sound energy which could comprise reverberation or other ambient sounds. The ratio or energy parameters may vary in time and/or frequency. It is to be appreciated that the directional parameter may vary in time and/or frequency.

The example electronic device 21 of FIG. 2 also comprises an array of cameras 25. The cameras within the array 25 may comprise any means which enables images to be obtained. Each of the cameras may comprise an image sensor which may be configured to convert light incident on the image sensor into an electrical signal to enable an image to be produced. The image sensors may comprise, for example, digital image sensors such as charge-coupled-devices (CCD) or complementary metal-oxide-semiconductors (CMOS).

The array of cameras 25 may comprise a plurality of cameras. The plurality of cameras may be distributed throughout the electronic device 21 so that the array of cameras 25 can obtain panoramic images or any other suitable types of images. The images obtained by the array of cameras 25 may be used for presence applications, virtual reality applications or any other suitable applications. The array of cameras 25 may be positioned within the electronic device 21 so as to enable high quality images to be obtained.

The positions of the cameras within the electronic device 21 may restrict the positions available for the first array of microphones 23 within the electronic device 21.

In other examples the electronic device 21 may comprise a single camera which may be arranged to obtain a panoramic or three dimensional image or any other suitable type of image. In other examples the electronic device could comprise components other than cameras.

The array of cameras 25 may be arranged to obtain still images and/or video images. The array of cameras 25 may be arranged to obtain images at the same time as the first array of microphones 23 obtains an audio signal.

The array of cameras 25 may be coupled to the apparatus 1 to enable the apparatus 1 to process image signals detected by the array of cameras 25.

The interface 29 may comprise any means which may enable the electronic device 21 to exchange information with another electronic device. In the example of FIG. 2 the interface 29 is arranged to enable the electronic device 21 to exchange information with the second set of microphones 27. In some examples the interface 29 may be arranged to enable the electronic device 21 to exchange information with a remote device such as a playback device or a processing device.

In some examples the interface 29 may comprise a wire or other physical connection. In other examples the interface 29 may comprise one or more transceivers which may enable a wireless communication connection between the electronic device 21 and the second set of microphones 27. The wireless communication connection may be a short range wireless communication connection or any other suitable type of wireless communication connection.

In the example of FIG. 2 a second set of microphones 27 is provided. The second set of microphones 27 may be provided externally to the electronic device 21. The second set of microphones 27 are provided outside of the casing of the electronic device 21 while the first set of microphones 23 are provided inside the casing of electronic device 21.

In the example of FIG. 2 the second set of microphones 27 is coupled to the electronic device 21. The second set of microphones 27 could be provided external to the electronic device 21 but connected to the electronic device 21 by a wire or other suitable connection means. In such examples the second set of microphones 27 may be provided a fixed distance from the electronic device 21. In such examples the wire or other physical connection may enable power to be provided from the electronic device 21 to the second set of microphones 27. In some examples the second set of microphones 27 may be connected the electronic device 21 by a floating mount which may be arranged to dampen any vibrations from the electronic device 21 which may affect the quality of the audio signals captured by the second set of microphones 27. In some examples the floating mount may also dampen vibrations from other sources such as footsteps or any other environmental sources. The floating mount may comprise one or more springs or any other suitable means.

In other examples the second set of microphones 27 may be provided separate to the electronic device 21. In such examples there is no physical connection between the second set of microphones 27 and the electronic device 21. In such examples the electronic device 21 and the second set of microphones 27 may exchange information via a wireless connection. This may enable the second set of microphones 27 to be moved relative to the electronic device 21.

The second set of microphones 27 are provided close to the electronic device 21. The second set of microphones 27 may be provided close to the electronic device 21 so that the first set of microphones 23 and the second set of microphones 27 are positioned in a similar sound field. The second set of microphones 27 may enable at least part of the sound field to be captured. The second set of microphones 27 may enable signal information from the sound field to be obtained. The second set of microphones 27 may be positioned close to the electronic device 21 so that the first set of microphones 23 and the second set of microphones 27 detect the same or substantially the same audio signal from a sound source 47.

The second set of microphones 27 may comprise any means which enables an audio signal to be obtained. The microphones within the second set of microphones 27 may comprise any means which may be configured to convert an acoustic input signal to an electrical output signal.

The second set of microphones 27 may be arranged to exchange information with the electronic device 21 via the interface 29. This enables the apparatus 1 within the electronic device 21 to obtain the one or more signals 33 relating to a captured sound field captured by the second set of microphones 27. The apparatus 1 may then process the one or more signals 33 captured by the second set of microphones 27 using the spatial information 39 obtained from the first set of microphones 23.

The second set of microphones 27 may comprise any suitable number of microphones. In some examples the second set of microphones 27 may comprise a single microphone. In other examples the second set of microphones 27 may comprise two or more microphones.

The first set of microphones 23 may comprise more microphones than the second set of microphones 27. The number and the positions of the microphones in the first set 23 may be arranged to optimise the obtaining 51 of the spatial information 39 of the audio signal. The number and position of the microphones in the second set 27 of may be optimised to obtain a high quality audio signal. The second set of microphones 27 does not need to be arranged to obtain spatial information as the spatial information 39 used for the spatial processing 45 is obtained from the first set of microphones 23.

The second set of microphones 27 may be arranged to obtain a higher quality audio signal than the first set of microphones 23. In some examples the second set of microphones 27 may be arranged to obtain a higher quality audio signal by being located separate to the electronic device 21. In such examples the audio signal obtained by the first set of microphones 23 will detect noise made by components of the electronic device 21 because the microphones 23 in the first set 23 are located close to these components. For instance, components such as the array of cameras 25, cooling components such as fans or any other components of the electronic device 21 may generate noise which will be detected by the first set of microphones 23. This will distort the signals 31 captured by the first set of microphones 23. As the second set of microphones 27 is external to the electronic device 21 the second set of microphones 27 does not detect the noises generated by these components and so the one or more signals 33 captured by the second set of microphones 27 have a higher signal to noise ratio.

In some examples the second set of microphones 27 may be arranged to obtain a higher quality audio signal because the second set of microphones 27 may comprise higher quality microphones than the first set of microphones 23. For instance the second set of microphones 27 may comprise microphones having larger diaphragms compared to the microphones in the first set 23. The large diaphragms may provide for a high signal to noise ratio in any captured audio signals. The large diaphragms could be over 2 cm in diameter or any other suitable size while the smaller diaphragms could be around 1 mm.

In some examples the second set of microphones 27 may be arranged to obtain a higher quality audio signal as because the microphones within the second set 27 may be arranged to be protected from parameters which may cause distortion of the captured audio signal. For example the second set of microphones 27 may be shielded to protect the microphones within the set 27 from detecting wind noise. It might not be feasible to provide such shielding for the first set of microphones 23 as such shielding may obstruct the images obtained by the array of cameras 25 and/or may increase the complexity of the electronic device 21.

In the example of FIG. 2 the apparatus 1 which obtains the signals from the sets of microphones 23, 25 and performs the spatial processing 45 is provided within the electronic device 21 which also comprises the first set of microphones 23. It is to be appreciated that the apparatus 1 could be provided in any suitable electronic device 21. For instance, in some examples the apparatus 1 could be provided in a remote device such as a server, play back device or other processing device. The remote device may be arranged to receive the signal comprising the spatial information 39 from the first set of microphones 23 and the signal comprising the audio signal captured by the second set of microphones 27. Some or all of the processing of the audio signals may then be performed remotely to the electronic device 21 and the second set of microphones 27.

Figure 3:
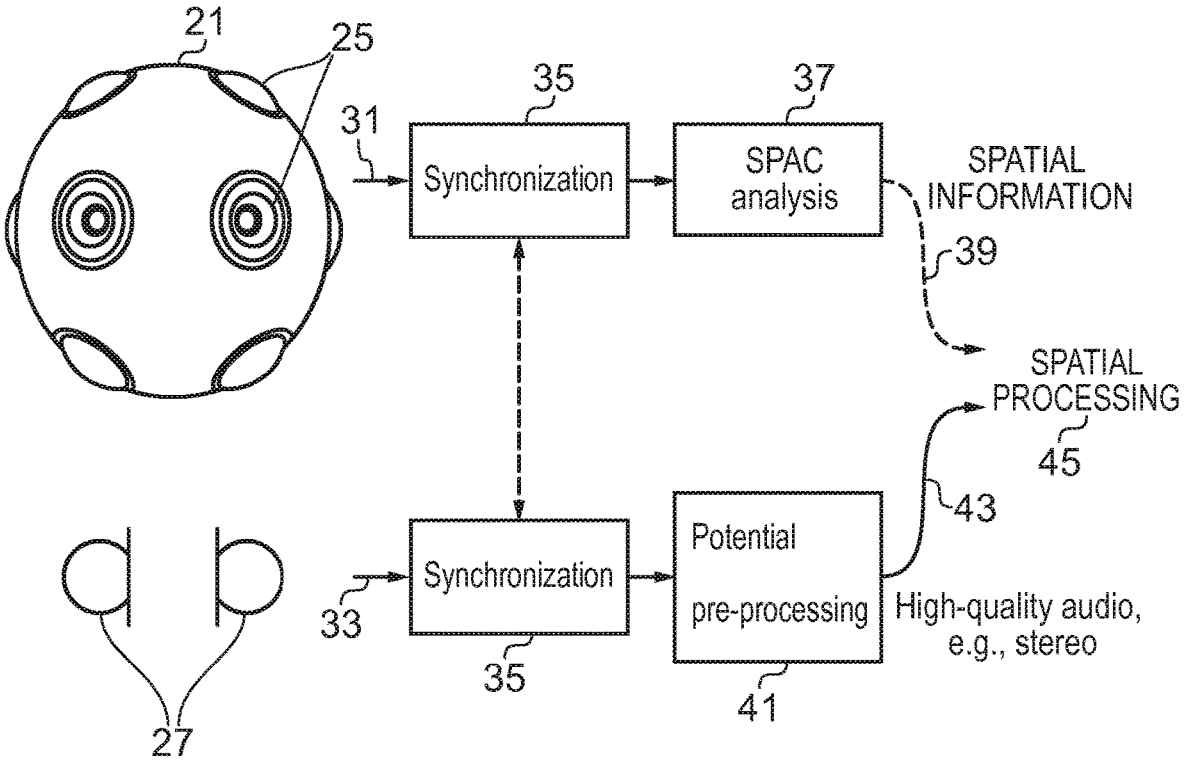
FIG. 3 illustrates an electronic device.

FIG. 3 illustrates an electronic device 21 and a second set of microphones 27 which may be used in some examples of the disclosure.

In the example of FIG. 3 the electronic device 21 comprises a presence capture device. The presence capture device comprises a spherical or substantially spherical casing with a set of cameras 25 distributed around the casing. Other shapes of casing may be used in other examples of the disclosure. The set of cameras 25 may be arranged to obtain panoramic images such as 360° degree images or other suitable images.

The first set of microphones 23 is provided within the spherical casing of the electronic device 21. The first set of microphones 23 may comprise any suitable number of microphones which enables spatial information to be obtained. In the example of FIG. 3 the electronic device 21 may comprise eight microphones. In other examples the electronic device 21 may comprise at least three microphones to enable sufficient spatial information 39 to be obtained.

In some examples of the disclosure the first set of microphones may be arranged in a predetermined geometry. The predetermined geometry may be fixed within the casing of the electronic device 21. The predetermined geometry may depend on the electronic device 21 and the functions that the electronic device 21 is arranged to perform. For instance, in the example of FIG. 3 where the electronic device 21 is arranged for presence capture the first set of microphones 23 may comprise eight microphones arranged in a cubic geometry. A microphone could be provided on each corner of the cube. Other geometries may be used in other examples of the disclosure. In the example of FIG. 3 the predetermined geometry may be arranged for presence capture. The predetermined geometry may be arranged for other functions in other examples of the disclosure.

The microphones within the first set of microphones 23 may be small and/or low cost microphones. This may reduce the amount of space required for the microphones within the electronic device 21. This may also keep the cost of the electronic device 21 to a minimum.

In the example of FIG. 3 the second set of microphones 27 are provided separate to the electronic device 21. The second set of microphones 27 may comprise fewer microphones than the first set of microphones 23 as the second set of microphones 27 does not need to obtain the spatial information 39. In the example of FIG. 3 the second set of microphones 27 comprises two microphones. Other numbers of microphones may be provided in other examples of the disclosure. For instance, in some examples the second set of microphones 27 may comprise only one microphone. In examples where the second set of microphones 27 only comprises a single microphone a decorrelation process may be used on the audio signal captured by the single microphone to synthesize the spatial incoherence. The decorrelation process might not be needed if two or more microphones are provided in the second set 27. In some examples optimized algorithms could be used in place of a decorrelation process.

The second set of microphones 27 is arranged to obtain a high quality audio signal. The high quality audio signal may have a high signal to noise ratio. The high quality audio signal may have a high signal to noise ratio compared to the signals obtained by the first set of microphones 23.

In some examples the microphones within the second set of microphones 27 may comprise high quality microphones such as AKG C414 XLS. These microphones may have a signal to noise ratio of 88 dB. The microphones provided within the first set of microphones 23 may comprise small microphones with a signal to noise ratio of 65 dB for the same audio signal level. The difference in the signal to noise ratios would be clearly audible to a user even without taking factors such as the noise from the other components in the electronic device 21 into account.

The second set of microphones 27 is positioned close enough to the electronic device 21 so that the first set of microphones 23 and the second set of microphones 27 detect the same audio signal. In some examples the second set of microphones 27 may be positioned within 0.3 to 0.8 m of the electronic device 21. Other distances may be used in other examples of the disclosure.

The second set of microphones 27 may be located in any suitable position relative to the electronic device 21. The second set of microphones 27 may be positioned relative to the electronic device 21 so that the second set or microphones 27 does not obstruct the array of cameras 25 within the electronic device 21. In the example of FIG. 3 the second set of microphones 27 are positioned underneath the electronic device 21. In other examples the second set of microphones 27 may be positioned in a different location relative to the electronic device 21.

In the example of FIG. 3 the second set of microphones 27 comprises two microphones. The use of two microphones may enable a signal suitable for playback in headphones to be captured. The use of two microphones may enable binaural synthesis to be performed on the two audio channels captured by the two microphones. Using two microphones may avoid the need to use decorrelators that may be needed if only one microphone is used. The use of decorrelators may negatively affect the perceived quality of some audio signals. In some examples the second set 27 may comprise more than two microphones however the additional information obtained by the additional microphones might not provide any additional useful information in some examples of the disclosure.

In the example of FIG. 3 the signals 31 captured by the first set of microphones 23 is synchronized 35 with the signals 33 captured by the second set of microphones 27. As the two sets 23, 27 of microphones are positioned close to each the captured signals 31, 33 may represent audio signals from the same sound source 47.

The two captured signals 31, 33 are temporally synchronized using any suitable process to ensure that the spatial processing of the signal 33 obtained by the second set of microphones 27 is robust. The synchronization of the captured signals 31, 33 may be performed by the apparatus 1 within the electronic device 21.

In the example of FIG. 3 the synchronization is performed on the signals 31, 33 captured by the sets 23, 27 of microphones. In other examples the synchronization could be performed at a different stage of the processing. For instance, in some examples the synchronization could be performed on the one or more signals 33 captured by the second set of microphones 27 and the spatial information 39 obtained from the signal 31 captured by the first set of microphones 23. In some examples the synchronization could be performed on the one or more signals 33 captured by the second set of microphones 27 and the spatial information 39 obtained from the signal 31 captured by the first set of microphones 23.

Any suitable technique may be used for the synchronization. In some examples the synchronization may comprise using off-line impulse response measurements, accounting for known internal delays of the respective sets 23, 27 of microphones, by using correlation measurements between the signals 31, 33 captured by the respective sets 23, 27, by using time codes that may be attached to signals 31, 33 during audio capture, by manual synchronization or using any other suitable technique.

The signal 31 captured by the first set of microphones 23 may be processed 37 using any suitable spatial audio capture (SPAC) technique to obtain spatial information 39 relating to the audio signal. The spatial information 39 that is obtained may comprise direction information. The spatial information 39 may comprise indicating a directional property of the captured sound field. In some examples the spatial information may comprise a ratio, or an energy parameter which indicates the directionality of captured sound field. The ratio or energy parameter may indicate how much of the captured sound energy is directional. The ratio or energy parameters may vary in time and/or frequency. This information may correspond to how human hearing perceives spatial audio information. Therefore this spatial information 39 may enable accurate spatial sound reproduction.

It is to be appreciated that any suitable techniques may be used to obtain the spatial information 39 from the signal 31 captured by the first set of microphones 23. In some examples the technique may comprise directional audio coding (DirAC). The directional audio coding may comprise estimating a sound intensity vector adaptively in time and frequency. A directional parameter may then be obtained from the sound intensity vector. The directional audio coding may also comprise estimating a ratio parameter based on the absolute value of the sound field intensity with respect to the sound field energy in time-frequency intervals.

In some examples the technique used to obtain the spatial information 39 may comprise harmonic planewave expansion (HARPEX). The harmonic plane wave expansion may comprise estimating two simultaneous directions of arrival for each of a plurality of time-frequency intervals. In such examples a ratio parameter based on the absolute value of the sound field intensity, or other similar parameter, is not estimated as it would be in directional audio coding. In examples which use harmonic planewave expansion this information is inherent within the two directions of arrival because the directions of arrival will fluctuate rapidly in time-frequency instances where the directional energy is small.

Other techniques for obtaining spatial information 39 may be used in other examples of the disclosure.

The one or more signals 33 captured by the second set of microphones 27 relate to the captured sound field. The one or more signals 33 captured by the second set of microphones 27 may be processed 41 to obtain a high quality audio signal 43. The high quality audio signal 43 may have a high signal to noise ratio but might not comprise sufficient information to enable a spatial audio signal to be reproduced. The processing 41 may comprise equalization, dynamic processing or any other suitable processing. In some examples the processing 41 of the signal 33 obtained by the second set of microphones 27 may be omitted.

The high quality audio signal 43 is spatially processed 45 using the spatial information 39. In some examples the high quality audio signal 43 may be spatially processed by an apparatus 1 within the electronic device 21. In other examples the high quality audio signal 43 may be spatially processed by a remote apparatus 1.

In examples where the spatial processing 45 is performed by a remote apparatus 1 the electronic device 21 may be arranged to transmit the spatial information 39 and the high quality audio signal 43 to the remote apparatus 1. In such examples the spatial information 39 might be associated with the high quality audio signal 43 before the high quality audio signal 43 is transmitted. The association between the high quality audio signal 43 and the spatial information 39 combines the information in the two signals so that they can be transmitted and/or stored together. The spatial information 43 and the high quality audio signal 43 may be encoded and transmitted to the remote apparatus 1. Any suitable techniques may be used for the encoding and the subsequent decoding by the remote apparatus 1.

In the example of FIG. 3 only the spatial information 39 from the signal 31 captured by the first set of microphones 23 is needed. The other information in the signal 31 is not needed. In such examples the signal 31 that is captured by the first set of microphones 23 is not used once the spatial information 39 has been obtained. This may enable the signal 31 that is captured by the first set of microphones 23 to be discarded after the spatial information 39 has been obtained. In such examples the signal 31 that is captured by the first set of microphones 23 does not need to be stored in the memory circuitry 7 and/or transmitted to the remote apparatus 1.

The spatial processing 45 may comprise any process which combines the spatial information 39 with the high quality audio signal 43 to provide a high quality spatial audio signal 79. The high quality spatial audio signal 79 may comprise both the high signal to noise ratio of the signal 33 captured by the second set of microphones 27 and the spatial properties indicated by the spatial information 39 of the signal 31 captured by the first set of microphones 23.

Any suitable technique may be used for the spatial processing 45. In some examples spatial processing 45 may comprise a least-squares optimized mixing and decorrelating technique. Such techniques may process the spatial covariance matrix of the high quality audio signal 43 in each of a plurality of frequency bands. The technique may comprise estimating an input signal covariance matrix and formulating a mixing/decorrelation rule to process each of the plurality of frequency bands of the high quality audio signal 43. This obtains a target covariance property which indicates the required spatial characteristics.

In some examples the spatial processing 45 may comprise the division of the frequency bands of the high quality audio signal 43 into directional and non-directional components. Ratio parameters from the spatial information 39, which may be obtained using directional audio coding techniques, may be used to divide the high quality audio signal 43. The directional components may then be processed to the direction determined by the spatial information 39 using amplitude panning, head related transfer functions (HRTF) or any other suitable technique. The non-directional components may be processed as spatially incoherent.

The high quality spatial audio signal 79 may be provided to an audio output device such as a loudspeaker, headphones or any other suitable output device.

In some examples the spatial processing 45 may be performed by an apparatus 1 within the electronic device 1. In other examples the spatial processing may be performed by an apparatus 1 within a remote device. In such examples the signals obtained by the apparatus 1 of the electronic device 21 are encoded and transmitted to the remote device for processing. The signals could be encoded using any suitable process such as advanced audio coding (AAC) or any other suitable technique. In some examples the signal 33 captured by the second set of microphones 27 may be encoded and transmitted. The spatial information 39 obtained from the first set of microphones 23 may also be quantized and encoded and associated with the encoded signal 33 captured by the second set of microphones 27. In some examples the spatial information 39 could be provided as metadata within the encoded signal 33. In some examples image information obtained from the electronic devices 21 could also be included with the encoded signal 33.

Figure 4A:
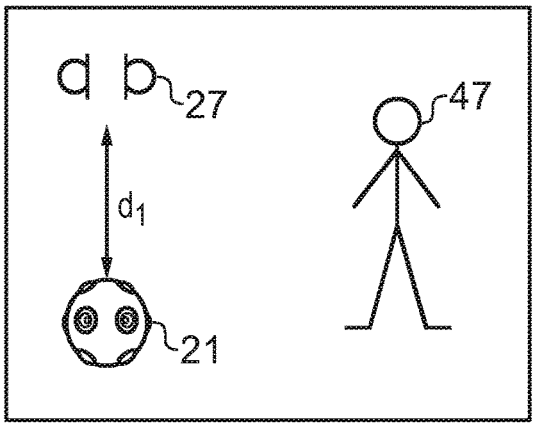
FIGS. 4A and 4B illustrate an electronic device.
Figure 4B:
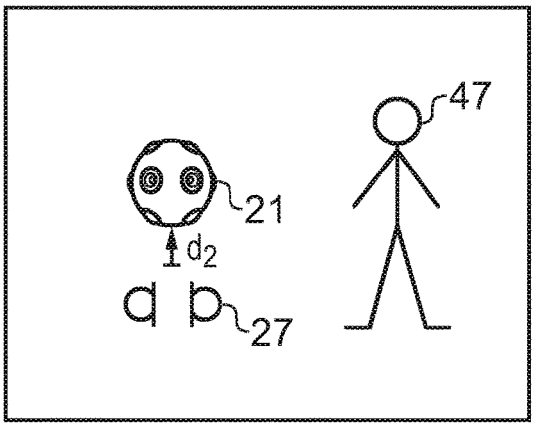

FIGS. 4A and 4B illustrate different arrangements of an electronic device 21 and a second set of microphones 27. In the examples of FIGS. 4A and 4B the electronic device 21 may comprise an image capturing device and the second set of microphones 27 may comprise two high quality microphones which may be as described above in relation to FIG. 3. Other electronic devices 21 and sets of microphones 23, 27 may be used in other examples of the disclosure.

In the examples of FIGS. 4A and 4B different distances are provided between the electronic device 21 and the second set of microphones 27. The distance between the electronic device 21 and the second set of microphones 27 may be dependent upon the proximity of the electronic device 21 to the sound source or the expected distance between the electronic device 21 and one or more of the sound sources 47 in the captured sound field.

In the example of FIGS. 4A and 4B the sound source 47 is a person. Other sound sources 47 may be used in other examples of the disclosure.

In the example of FIG. 4A the electronic device 21 and the second set of microphones 27 are located far away from the sound source 47. This arrangement could arise in a large room such as a theatre or concert hall where the electronic device 21 may be located tens of meters away from the sound source 47. As the electronic device 21 and the second set of microphones 27 are located far away from the sound source 47 a large separation may be provided between the electronic device 21 and the second set of microphones 27. This may still enable both the first set of microphones 23 and the second set of microphones 27 to detect substantially the same audio signal from the same sound source 47. In the example of FIG. 4A the distance $d_1$ between the electronic device 21 and the second set of microphones 27 may be several meters.

In the example of FIG. 4B the electronic device 21 and the second set of microphones 27 are located close to the sound source 47. This arrangement could arise in a small room such as a meeting room where the electronic device 21 could be located within several meters of the sound source 47. It is to be appreciated that the electronic device 21 could be located even closer to the sound source 47 in other arrangements.

As the electronic device 21 and the second set of microphones 27 are close to the sound source 47 a small separation may be provided between the electronic device 21 and the second set of microphones 27 so as to enable both the first set of microphones 23 and the second set of microphones 27 to detect substantially the same audio signal. In the example of FIG. 4B the distance $d_2$ between the electronic device 21 and the second set of microphones 27 may be around 0.3 m.

It is to be appreciated that other separations of the electronic device 21 and the second set of microphones 27 may be used in other examples of the disclosure. In some examples the distance between the electronic device 21 and the second set of microphones 27 may be adjustable so that a user can move the second set of microphones 27 relative to the electronic device 21. This may enable the user to change the relative position dependent on the relative position of the electronic device 21 and the sound source 47. In other examples the distance between the electronic device 21 and the second set of microphones 27 may be fixed. In such examples the electronic device 21 may be optimized for obtaining images and audio at a certain distance from a sound source 47.

Figure 5:
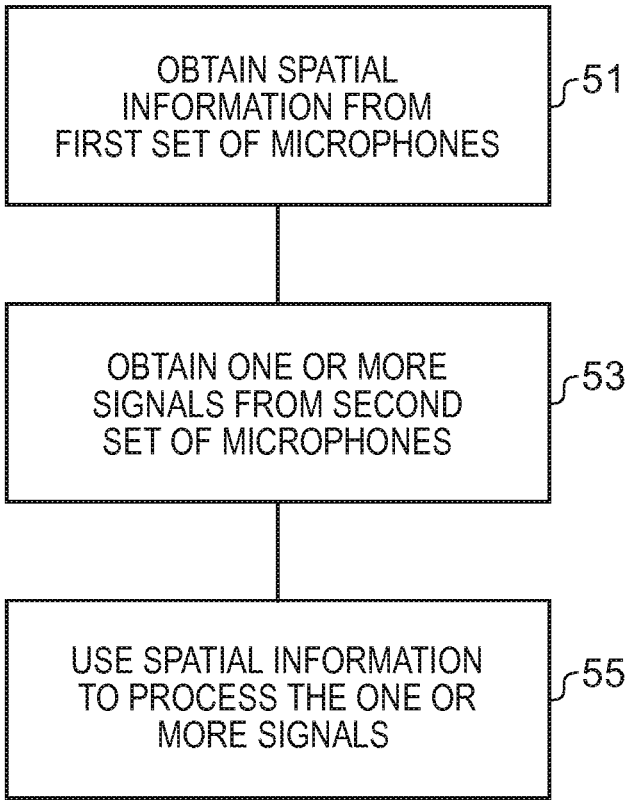
FIG. 5 illustrates a method.

FIG. 5 illustrates a method according to examples of the disclosure. The method may be implemented using apparatus 1 and electronic devices 21 as described above. In some examples the method may be implemented using an apparatus 1 within an electronic device 21 as described above. In other examples the method may be implemented by an apparatus 1 which is provided remote to the microphone sets 23, 27.

The method comprises, at block 51, obtaining spatial information 39 relating to a captured sound field from a first set of microphones 23 The method also comprise, at block 53, obtaining one or more signals from a second set of microphones 27 where the one or more signals relate to the captured sound field and using the obtained spatial information 39 from the first set of microphones 23 to process the one or more signals obtained from the second set of microphones 27. The first set of microphones 23 is provided within an electronic device 21 and the second set of microphones 27 is provided external to the electronic device 21.

Figure 6:
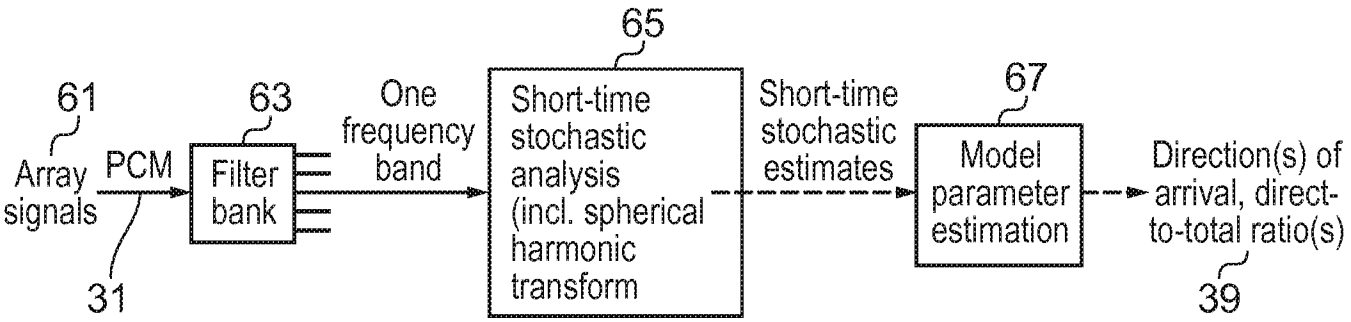
FIG. 6 illustrates a method.

FIG. 6 illustrates a method that may be used for processing the signal 31 captured by the first set of microphones 23 to obtain spatial information 39 relating to the audio signal. The method may be performed at block 37 in FIG. 3. Before the method of FIG. 6 is performed the signal 31 is captured by the first set of microphones 23 and is synchronized with the signal 33 captured by the second set of microphones 27.

The example method of FIG. 6 may be performed by the apparatus 1 of the electronic device 21. In other examples the signal 31 captured by the first set of microphones 23 may be provided to remote apparatus 1 to enable the remote apparatus 1 to perform the method or at least part of the method.

At block 61 the signal 31 captured by the first set of microphones 23 is received by the apparatus 1. In the example of FIG. 6 the signal 31 may be provided in a digital form. In the example of FIG. 6 pulse code modulation (PCM) is performed to convert the analogue signal captured by the microphones into a digital form. Other techniques may be used in other examples of the disclosure.

At block 63 the signal 31 is decomposed into a plurality of frequency bands. The signal 31 may be decomposed into a plurality of frequency bands using any suitable means. In the example of FIG. 6 a filter bank is used to decompose the signal 31 into frequency bands. The filter bank may comprise a short-time Fourier transform (STFT) a complex modulated quadrature mirror filter (QMF) bank or any other suitable means.

At block 65 the stochastic properties of each of the plurality of frequency bands is estimated. The stochastic properties may be used to obtain the spatial information 39.

In the example method of FIG. 6 a spherical harmonic transform may also be performed at block 65. The spherical harmonic transform may comprise a microphone signal pre-processing application which transforms the plurality of frequency bands of the signal 31 captured by the first set of microphones 23 into a spherical harmonic such as a B-format signal. The B-format signal may comprise four spherical harmonic signals. The four spherical harmonic signals may comprise an omnidirectional signal, and three figure-of-eight signals organized orthogonally to each other. The three figure of eight signals may be aligned with an x axis, a y axis and a z axis. Other directional format signals may be used in other examples of the disclosure.

In the example of FIG. 6 the directional format signal is used to estimate the short time stochastic properties. Any suitable technique may be used to estimate the short time stochastic properties. In some examples the technique may comprise formulating a cross-correlation of the omnidirectional signal with respect to each of the figure-of-eight signals. The result of the cross-correlation is the sound field intensity vector which can be used in techniques such as directional audio coding.

The short time stochastic properties may be estimated for each frequency band and for a plurality of different time intervals. An averaging operator may be used over the different frequencies and/or time intervals.

Once the short-time stochastic estimates have been obtained, at block 67, the spatial information 39 is obtained. In the example of FIG. 6 model parameter estimation is used to obtain the spatial information 39 from the short-time stochastic estimates. The spatial information 39 may comprise the direction of arrival, the direct to total energy ratio and any other suitable information. The direction of arrival parameter indicates a direction of arriving sound, and the direct to total energy ratio parameter indicates the proportion of the sound energy that is directional. Other parameters may be used in other examples of the disclosure. For example the parameters could comprise information such as direct to ambient ratio or an ambient to total ratio. The spatial information 39 may be obtained for each of the frequency bands.

The spatial information 39 maybe stored in the memory circuitry 7 of the apparatus 1 so that the spatial information 39 may be used for spatial processing 45. In some examples the spatial information 39 may be transmitted to another electronic device to enable the spatial processing 45 to be performed by another electronic device.

Figure 7:
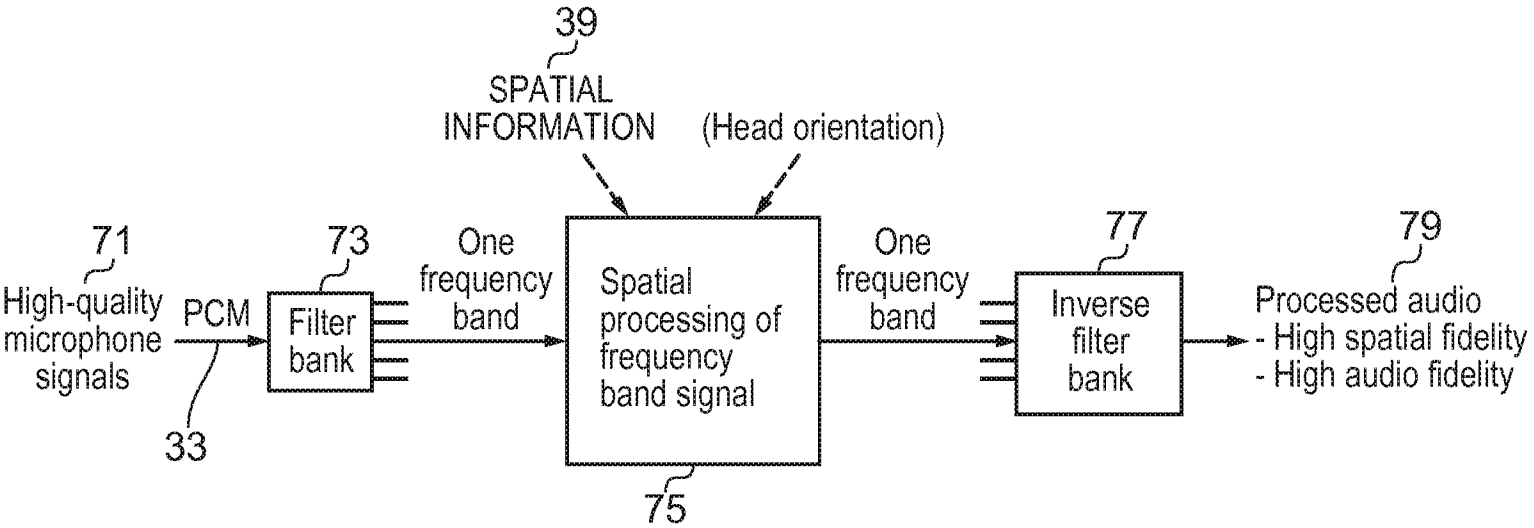
FIG. 7 illustrates a method.

FIG. 7 illustrates a method illustrates a method that may be used for spatially processing the signal 33 captured by the second set of microphones 27. The method may be performed at block 45 in FIG. 3. Before the method of FIG. 7 is performed the signal 33 is captured by the second set of microphones 27 and is synchronized with the signal 31 captured by the first set of microphones 23.

The example method of FIG. 7 may be performed by the apparatus 1 of the electronic device 21. In other examples the signal 33 obtained by the second set of microphones 27 may be provided to a remote apparatus 1 to enable the remote apparatus 1 to perform the method or at least part of the method.

At block 71 the signal 33 captured by the second set of microphones 27 is received by the apparatus 1. In the example of FIG. 7 the signal 33 may be provided in a digital form. In the example of FIG. 7 pulse code modulation (PCM) is performed to convert the analogue signal into a digital form. Other techniques may be used in other examples of the disclosure.

At block 73 the signal 33 is decomposed into a plurality of frequency bands. The signal 33 may be decomposed into a plurality of frequency bands using any suitable means. In the example of FIG. 7 a filter bank is used to decompose the signal 33 into frequency bands. The filter bank may comprise a short-time Fourier transform (STFT), a complex modulated quadrature mirror filter (QMF) bank or any other suitable means.

At block 75 each of the frequency bands are spatially processed using the spatial information 39 obtained from the first set of microphones 23.

In some examples the orientation of the user's head may also be used to spatially process the frequency bands of the signal 33 captured by the second set of microphones 27. In such examples information indicative of the user's head position is received at block 75. The information indicative of the user's head position may be used to rotate the directional parameters within the spatial information 39 so that they correspond to the current position of the user's head. Information indicative of the user's head position may be obtained from a head mounted display or any other suitable device. Considering the directional parameters as vectors and using rotation matrices or any other suitable process may be used to enable the directional parameters of the spatial information 39 to correspond to the current position of the user's head.

Any suitable technique may be used for the spatial processing. In some examples the spatial processing may comprise a covariance matrix based technique. In such examples a mixing rule may be formulated for an input frequency band so that the output signal has the directional properties determined by the spatial information 39. A mixing rule may be determined for each of the input frequency bands.

At block 77 the spatially processed signal is transformed into a time domain signal. The spatially processed signal may be transformed into the time domain using an inverse filter bank or any other suitable technique.

This provides a high quality spatial audio signal 79. The high quality spatial audio signal 79 uses the high signal to noise ratio of the signal 33 captured by the second set of microphones 27 and the spatial information 39 obtained from the signal 31 captured by the first set of microphones 23. The high quality spatial audio signal 79 may be provided to an output device such as a loudspeaker, or headphones for playback to a user.

Examples of the disclosure provide an apparatus 1, electronic device 21 and method for providing a high quality spatial audio signal 79. In examples of the disclosure the spatial information 39 originates from a first set of microphones 23 and the high quality audio signal 43 originates from a second set of microphones 27. As the different sets 23, 27 of microphones are arranged to obtain different information the different sets 23, 27 can be optimized for the specific purpose. For instance the number and position of microphones within the first set of microphones 23 may be optimized to enable spatial information 39 to be obtained while the parameters of the microphones in the second set 27 may be optimized to enable a high quality audio signal 43 to be captured but do not need to be arranged to obtain spatial information 39.

Examples of the disclosure also enable high quality microphones to be used in the second set of microphones 27. The high quality microphones may be useful for recording audio signals which have occasional silences or periods of very low signal levels. This may enable examples of the disclosure to be used to obtain high quality spatial audio signals 79 from different types of sound sources 47. For instance, the second set of microphones may be suitable for obtaining high quality recordings of classical music or other similar sound sources 47.

Examples of the disclosure also allow the second set of microphones 27 to be protected from environmental parameters such as wind. This may be useful for embodiments where the electronic device 21 is being used to capture images of outdoor scenes as it might not be possible to protect the first set of microphones 23 from these parameters.

As the second set of microphones 27 is provided externally to the electronic device 21 this may enable different types of microphones to be used with the same electronic device 21. For instance, this may enable a user to use a first type of microphones within the second set 27 to record a audio from a first sound source 47 and use a second, different type of microphone to record audio from a second sound source 47. The different types of microphones could be optimized for capturing different types of audio signals from different types of sound sources 47.

Also as the second set of microphones 27 are provided externally to the electronic device 21 this may enable a user to select a directional pick up pattern for the second set of microphones 27. For instance the user may select a pick up pattern so that sounds coming from particular directions are attenuated. This may enable sounds coming from the electronic device 21, or other sources of noise, to be attenuated so that the second set of microphones 27 can provide a higher signal to noise ratio.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although examples of the disclosure have been described in the preceding paragraphs with reference to various examples, it should be appreciated that modifications to the examples given can be made without departing from the scope of the invention as claimed. For instance, in the examples described above a connection is provided to enable information to be exchanged between the electronic device 21 and the second set of microphones 27. In other examples the connection might not be needed as the electronic device 21 and the second set of microphones 27 may be arranged to exchange information with a remote device. The remote device may perform the processing of the signals 31, 33 captured by the sets of microphones 23, 27. The processing may be performed in real time as soon as the signals are received by the remote device. In other examples the signals 31, 33 could be stored by the remote device and the processing could be carried out at a later time.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

processing circuitry; and memory circuitry including computer program code, the memory circuitry and the computer program code configured to, with the processing circuitry, enable the apparatus to:

obtain spatial information relating to a captured sound field based, at least partially, on one or more signals captured with a first set of microphones, wherein at least a part of the captured sound field is captured with the first set of microphones, wherein obtaining the spatial information enables the apparatus to:

perform frequency band analysis of the captured one or more signals for a plurality of time intervals, and obtain the spatial information based on the frequency band analysis;

obtain one or more signals from a second set of microphones where the one or more signals relate to the captured sound field; and use the obtained spatial information from the first set of microphones to process the one or more signals obtained from the second set of microphones, wherein processing the one or more signals obtained from the second set of microphones enables the apparatus to:

divide the one or more signals obtained from the second set of microphones into a plurality of frequency bands, and process the plurality of frequency bands according to the obtained spatial information;

wherein the first set of microphones is provided at least partially integrated with an electronic device and the second set of microphones is provided external to the electronic device.

2. An apparatus as claimed in claim 1, wherein the spatial information from the first set of microphones is used to spatially process the one or more signals obtained from the second set of microphones.

3. An apparatus as claimed in claim 1, wherein the second set of microphones are arranged to obtain a higher quality audio signal than a quality of audio signal obtained with the first set of microphones.

4. An apparatus as claimed in claim 1, wherein the second set of microphones comprise one or more higher quality microphones than the first set of microphones.

5. An apparatus as claimed in claim 1, wherein the second set of microphones are separated from components which reduce the quality of the obtained one or more signals.

6. An apparatus as claimed in claim 1, wherein the first set of microphones are arranged in a predetermined geometry, and wherein the obtained spatial information further comprises at least one of:

at least one direction of arriving sound, information regarding directional and nondirectional components of the captured sound field, at least one direct to total energy ratio, or at least one diffuseness value.

7. An apparatus as claimed in claim 1, further comprising an image capturing component.

8. An apparatus as claimed in claim 1, wherein the first set of microphones comprises more microphones than the second set of microphones.

9. An apparatus as claimed in claim 1, wherein the second set of microphones are positioned close to the electronic device so that the first set of microphones and the second set of microphones are positioned in a similar sound field.

10. An apparatus as claimed in claim 1, wherein the second set of microphones are coupled to the electronic device.

11. A device comprising the apparatus as claimed in claim 1, the device comprising an output interface, an input interface, the first set of microphones, and the device is configured to exchange information with the second set of microphones.

12. A method comprising:

obtaining spatial information relating to a captured sound field based, at least partially, on one or more signals captured with a first set of microphones, wherein at least a part of the captured sound field is captured with the first set of microphones, wherein the obtaining of the spatial information comprises:

performing frequency band analysis of the captured one or more signals for a plurality of time intervals, and obtaining the spatial information based on the frequency band analysis;

obtaining one or more signals from a second set of microphones where the one or more signals relate to the captured sound field; and using the obtained spatial information from the first set of microphones to process the one or more signals obtained from the second set of microphones, wherein processing the one or more signals obtained from the second set of microphones comprises:

dividing the one or more signals obtained from the second set of microphones into a plurality of frequency bands, and processing the plurality of frequency bands according to the obtained spatial information;

wherein the first set of microphones is provided at least partially integrated with an electronic device and the second set of microphones is provided external to the electronic device.

13. A method as claimed in claim 12 wherein the spatial information from the first set of microphones is used to spatially process the one or more signals obtained from the second set of microphones.

14. A method comprising as claimed in claim 12, wherein the second set of microphones are arranged to obtain a higher quality audio signal than a quality of audio signal obtained with the first set of microphones.

15. A method as claimed in claim 12, wherein the second set of microphones comprises one or more higher quality microphones than the first set of microphones.

16. A method as claimed in claim 12, wherein the second set of microphones are positioned close to the electronic device so that the first set of microphones and the second set of microphones are positioned in a similar sound field.

17. A computer program product comprising a non-transitory computer readable medium storing computer program instructions that, when executed with processing circuitry, enable:

obtaining spatial information relating to a captured sound field based, at least partially, on one or more signals captured with a first set of microphones, wherein at least a part of the captured sound field is captured with the first set of microphones, wherein the obtaining of the spatial information enables:

performing frequency band analysis of the captured one or more signals for a plurality of time intervals, and obtaining the spatial information based on the frequency band analysis;

obtaining one or more signals from a second set of microphones where the one or more signals relate to the captured sound field; and using the obtained spatial information from the first set of microphones to process the one or more signals obtained from the second set of microphones, wherein processing the one or more signals obtained from the second set of microphones enables:

dividing the one or more signals obtained from the second set of microphones into a plurality of frequency bands, and processing the plurality of frequency bands according to the obtained spatial information;

wherein the first set of microphones is provided at least partially integrated with an electronic device and the second set of microphones is provided external to the electronic device.

18. An apparatus as claimed in claim 1, wherein the electronic device comprises the apparatus.

19. An apparatus as claimed in claim 1, wherein the performing of the frequency band analysis of the captured one or more signals comprises determining at least a direction parameter and a ratio parameter for a frequency band of a plurality of frequency bands of the captured one or more signals, wherein the processing of the plurality of frequency bands according to the obtained spatial information comprises processing a frequency band of the plurality of frequency bands of the one or more signals obtained from the second set of microphones based, at least, on the direction parameter and the ratio parameter.

20. An apparatus as claimed in claim 1, wherein the performing of the frequency band analysis comprises determining a first directional parameter for a first frequency band of the captured one or more signals for the plurality of time intervals, and a second directional parameter for a second frequency band of the captured one or more signals for the plurality of time intervals, and wherein the processing of the one or more signals obtained from the second set of microphones comprises: processing a first frequency band of the one or more signals obtained from the second set of microphones based, at least partially, on the first directional parameter, and processing a second frequency band of the one or more signals obtained from the second set of microphones based, at least partially, on the second directional parameter.

* * * * *